US008478164B2

(12) United States Patent
Yamamoto

(10) Patent No.: US 8,478,164 B2
(45) Date of Patent: Jul. 2, 2013

(54) DEVELOPING DEVICE

(75) Inventor: Tatsuyuki Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 13/018,644

(22) Filed: Feb. 1, 2011

(65) Prior Publication Data

US 2011/0206419 A1 Aug. 25, 2011

(30) Foreign Application Priority Data

Feb. 25, 2010 (JP) ..... 2010-039954

(51) Int. Cl.
*G03G 15/04* (2006.01)
*G03G 15/09* (2006.01)

(52) U.S. Cl.
USPC ..... 399/119; 399/269

(58) Field of Classification Search
USPC ..... 399/119, 269, 270, 276
See application file for complete search history.

(56) References Cited

U.S. PATENT DOCUMENTS 6,735,410 B2 5/2004 Sekiguchi
6,947,689 B2 9/2005 Ikeda et al.
8,238,800 B2 8/2012 Hatano
2002/0181974 A1 12/2002 Sekiguchi
2004/0213601 A1 10/2004 Ikeda et al.

FOREIGN PATENT DOCUMENTS

CN 101398656 A 4/2009
JP 2002317825 A * 10/2002
JP 2002-351221 A 12/2002
JP 2004-151451 A 5/2004
JP 2007-171403 A 7/2007

OTHER PUBLICATIONS

Notification of the First Office Action dated May 9, 2012, in Chinese Application No. 201110042637.3.
Notice of Acceptance mailed Apr. 15, 2013, in Chinese Application No. 201110042637.3.

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

A developing device includes a first developer carrying member for forming a toner image on an image bearing member; a second developer carrying member for forming the toner image on the image bearing member; a supporting member for rotatably supporting the first developer carrying member; a swingable member for swinging the second developer carrying member about the first developer carrying member; an urging portion for urging the second developer carrying member toward the image bearing member; and a buffering portion, provided so as to press-contact the swingable member, for damping vibration of the swingable member.

4 Claims, 8 Drawing Sheets

DEVELOPING DEVICE

FIELD OF THE INVENTION AND RELATED ART

The present invention relates to a developing device for forming a toner image while conveying toner on two or more developer carrying members. Specifically, the present invention relates to a structure in which a pair of swingable members swingable about a rotational axis (rotation shaft) of one developer carrying member supports the other developer carrying member.

An image forming apparatus in which an electrostatic image formed on an image bearing member is developed into the toner image by using a developing device including two or more developer carrying members has been put into practical use (Japanese Laid-Open Patent Application (JP-A) 2007-171403). By using the two or more developer carrying members, a developer in a sufficient amount can be supplied even to the electrostatic image on the surface of the image bearing member which rotates at high speed, so that improper development by speed-up of a process speed of image formation can be prevented.

JP-A 2002-351221 discloses a developing device, using one component developer, in which a pair of developer carrying members (developing sleeves) is vertically arranged and disposed. In this developing device, on a rotation end side of a pair of swingable members swingable about a rotation shaft of an upper-side developer carrying member, a rotation shaft of a lower-side developer carrying member is supported, so that latitude with respect to a torsional direction is provided between the parallel developer carrying members. The pair of developer carrying members ensures an opposing gap of a predetermined value (200 μm) between a photosensitive drum and the surfaces of the developer carrying members by causing guide rollers disposed outside a developing container at both end portions of the rotation shafts to rotate in contact with the photosensitive drum.

JP-A 2004-151451 discloses a developing device, using a two-component developer, in which a pair of developer carrying members (developing sleeves) is vertically arranged and disposed. In this developing device, at upper and lower swinging end portions of a pair of swingable members swingable about a rotation shaft provided in a developing container, an upper-side developer carrying member and a lower-side developer carrying member are supported, respectively, so that forced load is not exerted on the photosensitive drum even when a positional relationship between the photosensitive drum and the developing device is changed. The pair of developer carrying members ensures an opposing gap of a predetermined value (300 μm) between a photosensitive drum and the surfaces of the developer carrying members by causing guide rollers (abutting portions) disposed outside the developing container at both end portions of the rotation shafts to rotate in contact with the photosensitive drum.

When an experiment for further increasing the process speed by using the developing device disclosed in JP-A 2007-171403 was conducted, it was found that a degree of the improper development and an amount of scattering of toner are increased. It was found that both end abutting rollers of the second developer carrying member excessively respond to vertical motion of the photosensitive drum surface or an amount of eccentricity of the abutting rollers to jump up and thus the opposing gap between the second developer carrying member and the image bearing member becomes unstable. It was found that both end abutting rollers of the second developer carrying member cannot smoothly trace (follow) the image bearing member surface which moves at high speed and therefore the second developer carrying member is in a vibration state.

When the opposing gap between the second developer carrying member and the image bearing member is increased, an electric field relating to the development is weakened and thus development efficiency is lowered. When the opposing gap is decreased, a degree of an occurrence of electric discharge is increased to impair (decrease) a lifetime of the photosensitive drum. When the opposing gap varies, image density non-uniformity becomes conspicuous and the amount of toner scattering is also increased, thus being inconvenience.

SUMMARY OF THE INVENTION

A principal object of the present invention is to provide a developing device, including a swingable member swingably holding a second developer carrying member about a first developer carrying member, capable of suppressing inconveniences caused by vibration of the swingable member.

According to an aspect of the present invention, there is provided a developing device comprising:

a first developer carrying member for forming a toner image on an image bearing member;

a second developer carrying member for forming the toner image on the image bearing member;

a supporting member for rotatably supporting the first developer carrying member;

a swingable member for swinging the second developer carrying member about the first developer carrying member;

urging means for urging the second developer carrying member toward the image bearing member; and buffering means, provided so as to press-contact the swingable member, for damping vibration of the swingable member.

These and other objects, features and advantages of the present invention will become more apparent upon a consideration of the following description of the preferred embodiments of the present invention taken in conjunction with the accompanying drawings.

Figure 4:
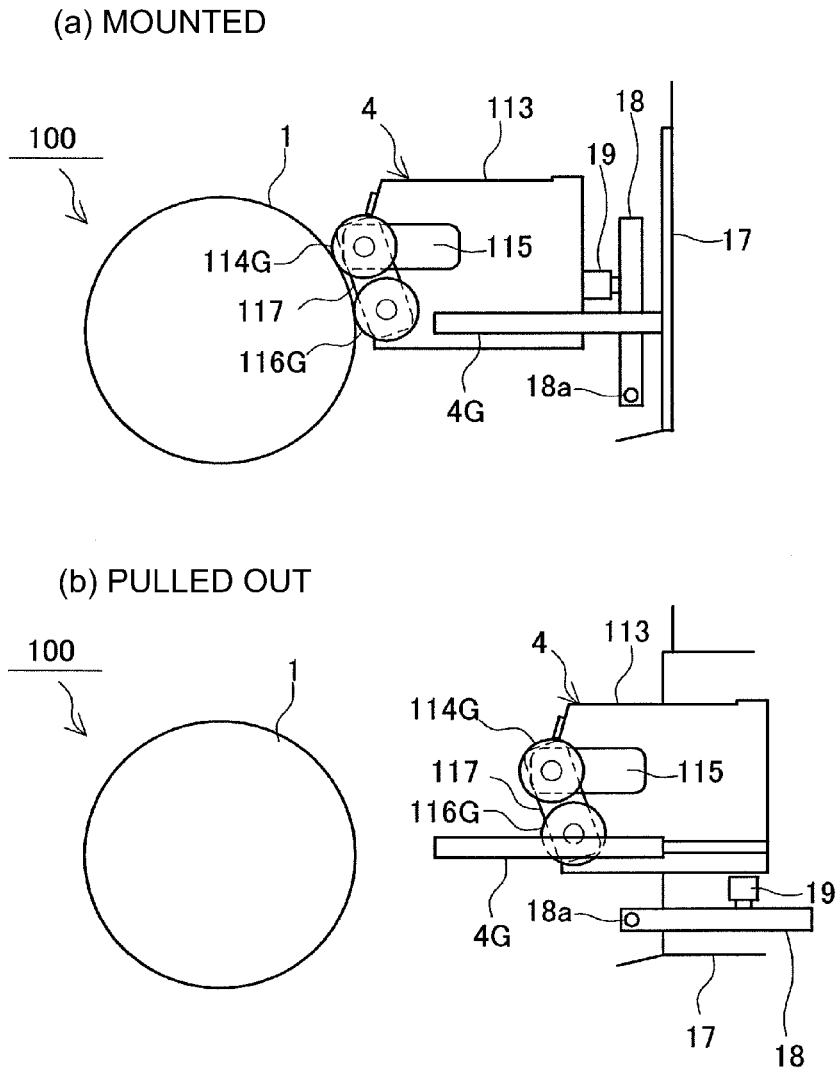

Parts (a) and (b) of FIG. 4 are illustrations of mounting and demounting of the developing device, respectively.

Figure 5:
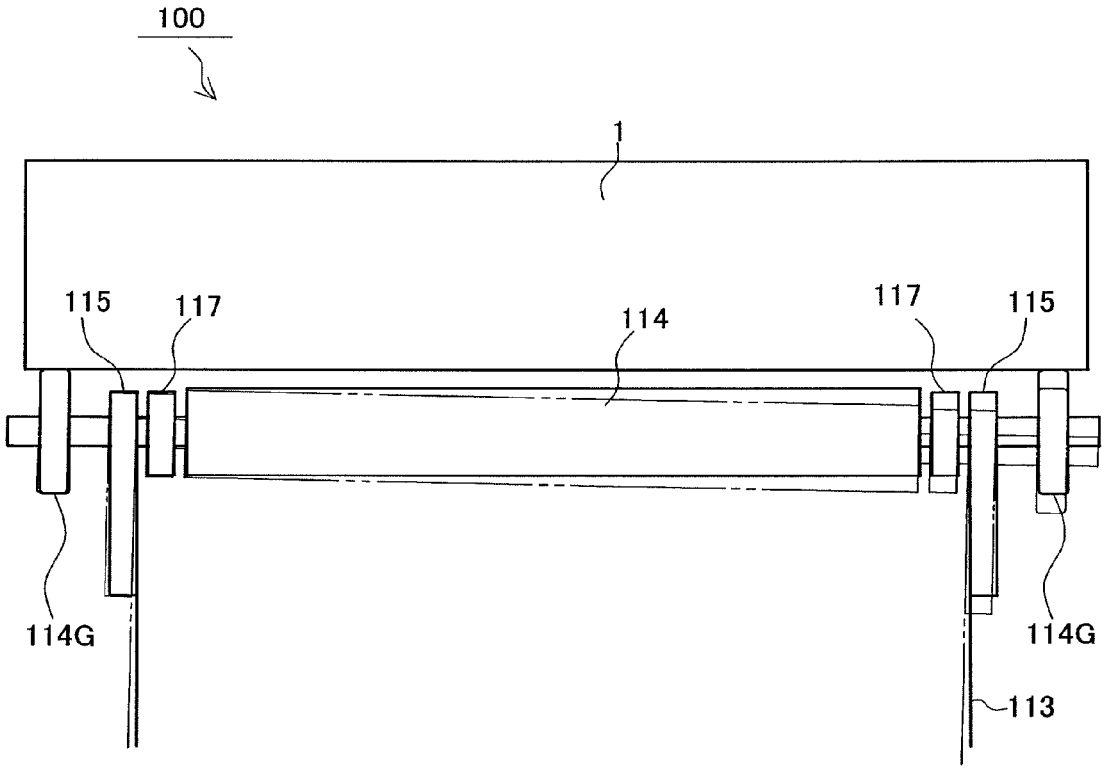

FIG. 5 is an illustration of play of the developing device.

Figure 6:
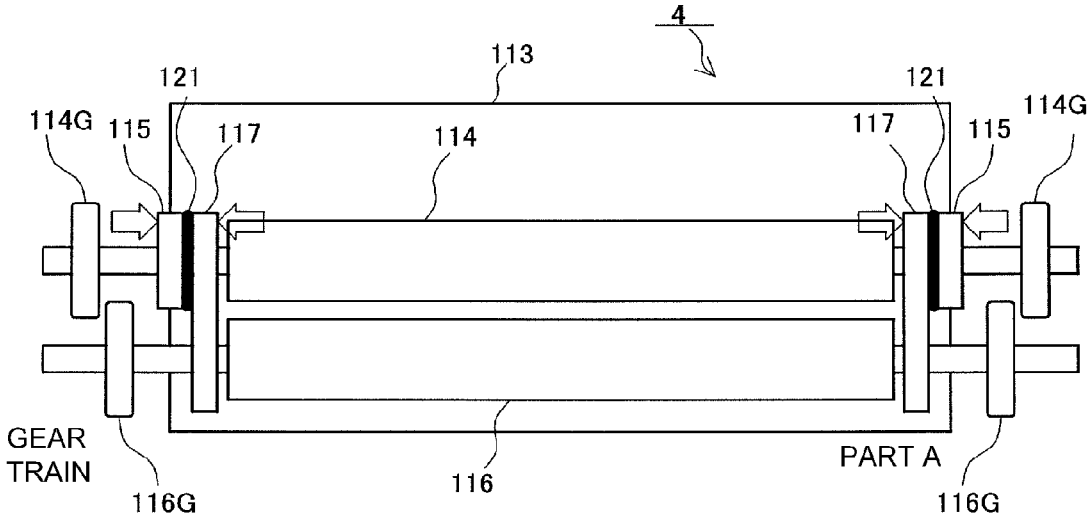

FIG. 6 is an illustration of a constitution of a developing sleeve supporting structure in Embodiment 1.

Figure 7:
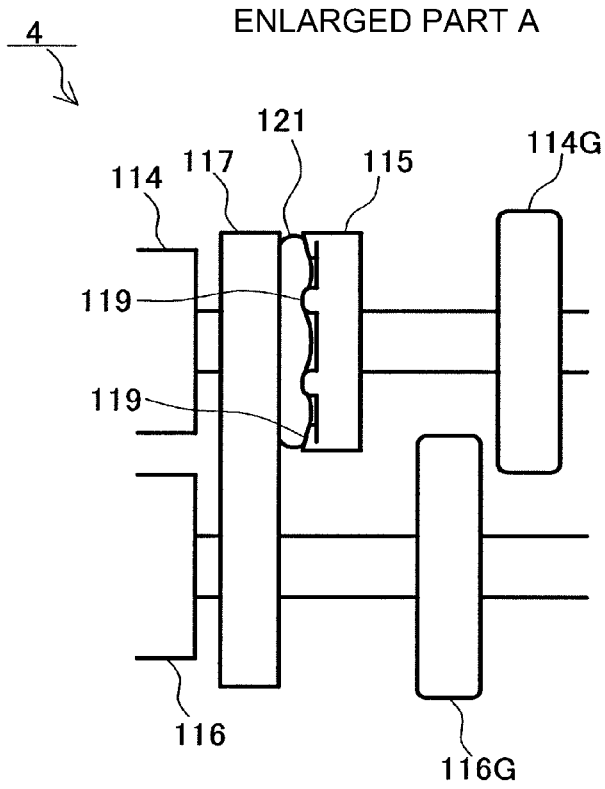

FIG. 7 is an enlarged view of a supporting portion of a swingable holder.

Figure 8:
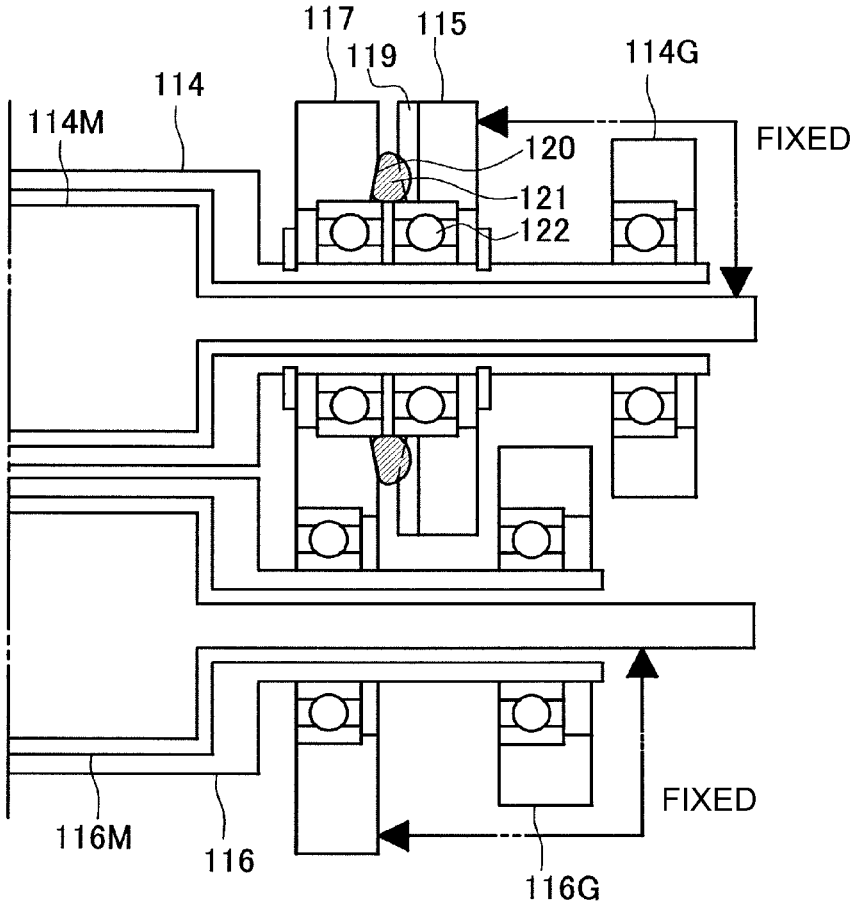

FIG. 8 is an illustration of arrangement of an elastic member.

DESCRIPTION OF THE PREFERRED EMBODIMENTS

Embodiments of the present invention will be described in detail with reference to the drawings. The present invention can also be carried out in other embodiments in which a part or all of constitutions in the following embodiments are replaced with their alternative constitutions so long as a developing device is demountable in a direction in which a developer carrying member is spaced from an image bearing member.

Therefore, the present invention can be carried out by the image forming apparatus including the developing device using magnetic toner irrespective of the types of charging and electrostatic image formation and irrespective of the types of intermediary transfer, recording material conveyance, transfer belt and sheet-feed printing.

In the following embodiments, only principal portions relating to formation of a toner image will be described but the present invention can be carried out in various uses such as a printer, various printing machines, a copying machine, a facsimile machine and a multi-function machine by adding necessary device, equipment and casing structure.

Incidentally, general matters of the image forming apparatuses described in JP-A 2007-171403, JP-A 2002-35122 and JP-A 2004-151451 will be omitted from illustration and redundant description.

<Image Forming Apparatus>

Figure 1:
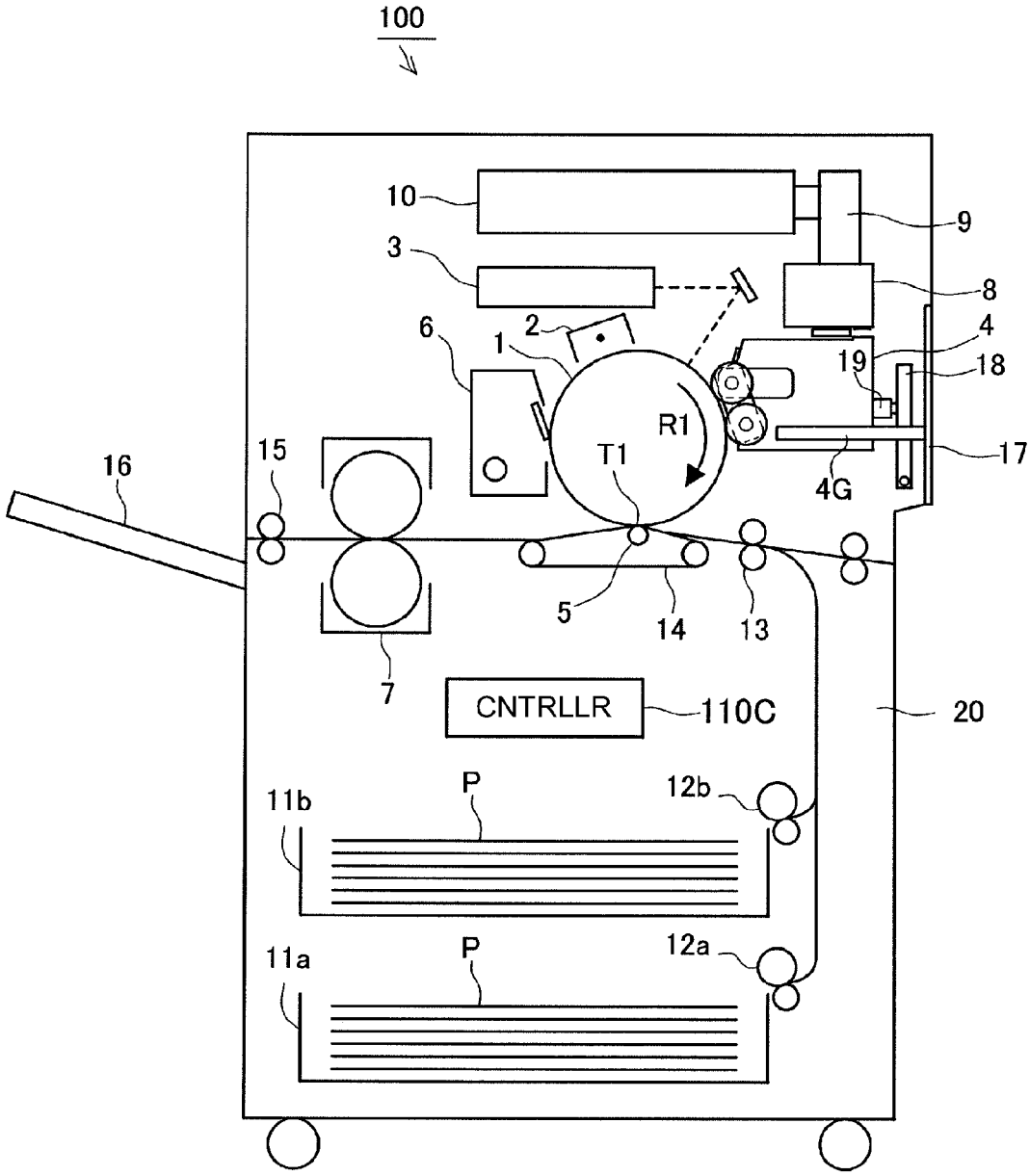
FIG. 1 is an illustration of a structure of an image forming apparatus.

FIG. 1 is an illustration of a structure of the image forming apparatus. As shown in FIG. 1, an image forming apparatus 100 is a high-speed monochromatic printer in which the toner image formed on a photosensitive drum 1 is transferred onto a recording material P carried on a transfer belt 14.

A corona charger 2, an exposure device 3, a developing device 4, a transfer roller 5 and a drum cleaning device 6 are disposed around the photosensitive drum 1 which is an example of the image bearing member. The photosensitive drum 1 is prepared by forming a photosensitive layer on an outer peripheral surface of an aluminum cylinder and is rotated in a direction indicated by an arrow R1 at a process speed of 700 mm/sec.

The corona discharger 2 uniformly charges the surface of the photosensitive drum 1 to a negative potential by irradiating the surface of the photosensitive drum 1 with charged particles by corona discharge. The exposure device 3 writes (forms) an electrostatic image for an image on the charged surface of the photosensitive drum 1 by scanning the photosensitive drum 1 surface with a laser beam, through a rotating mirror, which has been subjected to ON-OFF modulation of scanning line image data developed from an input image. The developing device 4 develops the electrostatic image formed on the photosensitive drum 1 into the toner image.

The transfer roller 5 presses an inner surface of the transfer belt 14 to form a transfer portion T1 between the photosensitive drum 1 and the transfer belt 14. The recording material P accommodated in a recording material cassette 11*a* is separated one-by-one by a separation roller 12*a* and is fed to registration rollers 13. The registration rollers 13 receive the recording material P in a rest state to place the recording material P in a stand-by state and then send the recording material P by being timed to the toner image on the photosensitive drum 1.

By applying a positive DC voltage to the transfer roller 5, the toner image carried on the photosensitive drum 1 is transferred onto the recording material P which is carried on the transfer belt 14 and passes through the transfer portion T1. The recording material P on which the toner image is transferred is separated by curvature from the transfer belt 14 and is sent into a fixing device 7. The recording material P is subjected to heat and pressure by the fixing device 7 to heat-fix the toner image on its surface and thereafter is discharged on a discharge tray 16 through discharging rollers 15.

The drum cleaning device 6 rubs the photosensitive drum 1 with a cleaning blade to collect transfer residual toner remaining on the photosensitive drum 1 without being transferred onto the recording material P. The toner is consumed by the image formation and therefore supply toner in an amount corresponding to a toner consumption amount is supplied from a developer bottle 10 to a hopper 9 and then is supplied from the hopper 9 to the developing device 4 via a buffer 8.

<Developing Device>

Figure 2:
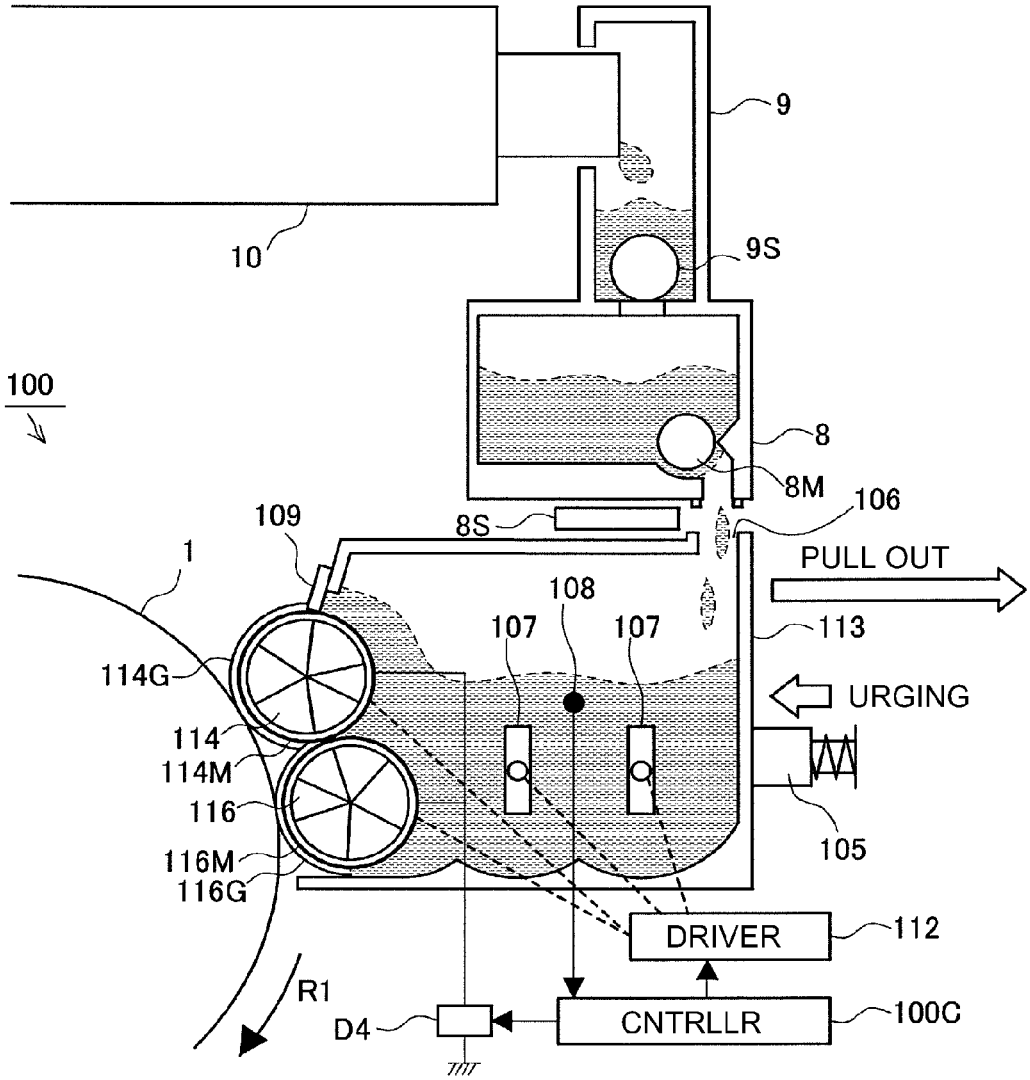
FIG. 2 is an illustration of a structure of a developing device.
Figure 3:
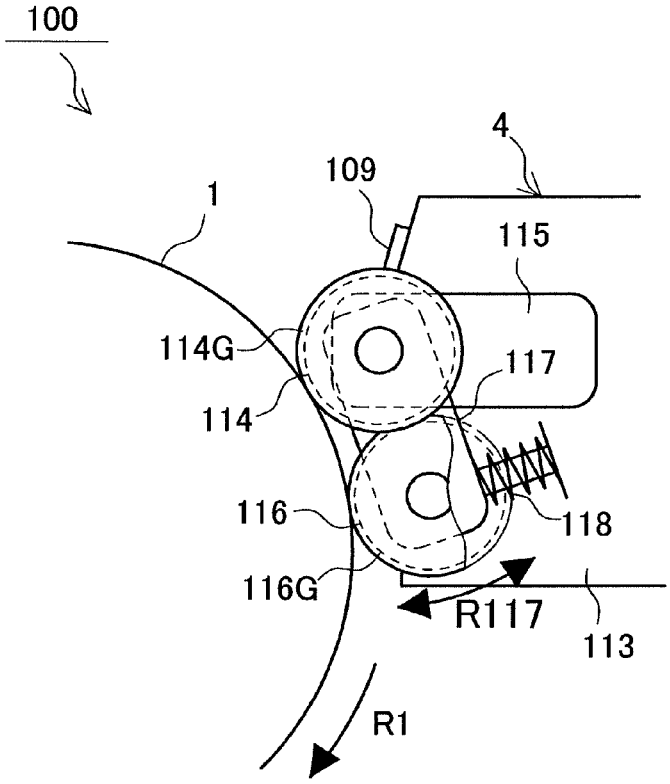
FIG. 3 is an illustration of a structure for setting an opposing gap between a developing sleeve and a photosensitive drum.

FIG. 2 is an illustration of a structure of the developing device. FIG. 3 is an illustration of a structure for setting an opposing gap between the developing sleeve and the photosensitive drum. Parts (a) and (b) of FIG. 4 are illustrations of mounting and demounting of the developing device, respectively. FIG. 5 is an illustration of play of the developing device.

As shown in FIG. 2, the developing device 4 carries the one component developer on a developing sleeve 114 which is an example of a first developer carrying member and on a developing sleeve 116 which is an example of a second developer carrying member, and develops the electrostatic image into the toner image on the photosensitive drum 1. A stationary magnet 114M is disposed inside the developing sleeve 114 located on an upstream side with respect to a rotational direction of the image bearing member, and a stationary magnet 116M is disposed inside the developing sleeve 116 located on a downstream side with respect to the rotational direction. The stationary magnets 114M and 116M attract the developer by magnetic flux and coat the surfaces of the developing sleeves 114 and 116 with the developer.

A developing blade 109 which is an example of a layer thickness regulating member regulates a layer thickness of the developer carried on the developing sleeve 114 and electrically charges the one component developer (magnetic toner) to a negative polarity by rubbing against the developer. The developer carried on the developing sleeve 114 is transferred from the developing sleeve 114 onto the developing sleeve 116 and an opposing portion where the developing sleeves 114 and 116 oppose each other.

A power source D4 applies an oscillating voltage, in the form of a DC voltage biased with an AC voltage, to the developing sleeves 114 and 116, so that the charged developer carried on the developing sleeves 114 and 116 is transferred onto the photosensitive drum 1 and thus the electrostatic image is reversely developed.

Right above the developing device 4, the buffer 8 for supplying the toner is provided. The buffer 8 stores the developer and evenly supplies the developer to a receiving opening 106 provided over a full length thereof with respect to a longitudinal direction of the buffer 8. By rotating a magnet roller 8M provided over a full length of the buffer 8 with respect to the longitudinal direction of the buffer 8, the developer in the amount corresponding to the amount of the developer consumed by the image formation is taken out and supplied to the receiving opening 106 of the developing device 4.

The developer bottle 10 is rotated by an unshown rotating mechanism and supplies the developer to the hopper 9. The hopper 9 rotates a feeding screw 9S by an angle corresponding to the supply amount, thus supplying the developer to the buffer 8. The buffer 8 supplies the toner (developer) to the developing device 4 evenly with respect to the longitudinal direction of the developing device 4 and thus a slope of the toner surface with respect to a disposed direction of the developing sleeves is less liable to be formed, so that the buffer 8 is effective in uniformly keeping an image density with respect to the disposed direction of the developing sleeves.

Stirring members 107 stir the developer, in a developing container 113, supplied from the receiving opening 106 and feed the developer to the developing sleeves 114 and 116 while keeping flowability of the developer. A toner sensor 108 detects an amount of AC current flowing between itself and the ground potential and outputs a signal corresponding to the amount of the developer in the developing container 113.

A controller 100C controls the feeding screw 9S and the magnet roller 8M depending on an output of the toner sensor 108. A driving portion 112 rotationally drives the stirring members 107 and the developing sleeves 114 and 116.

As shown in FIG. 3, a holder 115 is fixed to the developing device 4 and on the other hand, the developing sleeve 114 is contacted to the photosensitive drum 1 at both end abutting portions 114G by the rotational movement of the developing device 4 in a range of play of a slide guide 4G.

At both end portions of the developing sleeve 114, fixing rollers (abutting portions) 114G contact the photosensitive drum 1, so that the opposing gap (SD gap) between the developing sleeve 114 and the photosensitive drum 1 is set at an optimum value. When the opposing gap is excessively large, a transfer amount of the developer becomes insufficient, so that transfer efficiency at a high (image) density is lowered. When the opposing gap is excessively small, development non-uniformity becomes conspicuous. In this embodiment, the opposing gap (SD gap) is set at 200 μm by employing the fixing rollers 114G with a diameter 400 μm larger than that of the developing sleeve 114.

The developing sleeve 114 and the fixing rollers 114G are rotatably supported by the holder 115 which is an example of a supporting member fixing to the developing container 113. A swingable holder 117, which is an example of a swingable member, is mounted rotatably about the developing sleeve 114, and both end portions of the developing sleeve 116 are rotatably supported by end sides of the swingable holder 117 (FIG. 8).

The swingable holder 117 is urged toward the photosensitive drum 1 side by a lower sleeve urging mechanism 118. The lower-side developing sleeve 116 is swung about the upper-side developing sleeve 114 as a rotation center by the swingable holder 117 urged by the lower sleeve urging mechanism 118 provided on the developing sleeve 116. As a result, at both end portions of the developing sleeve 116, fixing rollers 116G contact the photosensitive drum 1, so that the opposing gap (SD gap) between the developing sleeve 116 and the photosensitive drum 1 is set at 200 μm which is the optimum value.

As shown (a) of FIG. 4, the slide guide 4G which is an example of a guiding means supports the developing device 4, including the developing container 113, the holder 115, the swingable holder 117, the developing sleeve 114 and the developing sleeve 116, movably in a direction in which the developing device 4 is to be spaced from the photosensitive drum 1.

The developing device 4 is urged toward the photosensitive drum 1 by an urging spring 19 provided on an inner door 18, so that the abutting rollers 114G are contacted to the photosensitive drum 1. The developing device 4 is substantially horizontally held slidably by the slide guide 4G and is urged by the urging spring 19 to contact the photosensitive drum 1. The developing device 4 urged by the urging spring 19 slides along the slide guide 4G to press the developing sleeve 114 held by the developing device 4, so that the fixing rollers 114G provided at both end portions of the developing sleeve 114 are abutted against the photosensitive drum 1.

As shown in (b) of FIG. 4, the urging of the developing device 4 toward the photosensitive drum 1 can be released by opening an outer cover 21 and then by laying the inner door 18 rightward on its side with a supporting shaft 18*a* as the center. The developing device 4 is guided by the slide guide 4G which is the sample of the guide means to be pulled out in a right-hand direction, so that the developing device 4 is demountable from the image forming apparatus 100. When the developing device 4 is pulled out, as shown in FIG. 2, a shutter 8S is configured to block the opening of the buffer 8.

As shown in FIG. 5 which illustrates a state of the developing device 4 as seen from above, with respect to the developing device 4, the holder 115 is fixed on the developing container 113. On the other hand, with respect to the developing device 4, both end fixing rollers 114G are contacted to the photosensitive drum 1 by the rotation of the developing container 113, supported by the slide guide 4B (FIG. 4), in the range of play thereof.

Incidentally, as described in JP-A 2002-351221 and JP-A 2004-151451, with respect to either one of the one component developer and the two component developer, a high-speed image forming apparatus in which the developing device including two or more developing sleeves was mounted has been conventionally put into practical use.

In the developing device provided with the two or more developing sleeves, the developing sleeves or outer abutting rollers of the developing sleeves were contacted to both end insulating ring portions of the photosensitive drum or insulating flanges provided outside the photosensitive drum. This is because the gap between the photosensitive drum and the developing sleeves is controlled with reliability.

As a result, even in the case where the image bearing member and the developer carrying members were out of alignment due to part accuracy, the gap was controlled with reliability by constituting the second developer carrying member swingably relative to the fixed first developer carrying member and by urging the second developer carrying member by the lower sleeve urging mechanism.

However, there arises a problem in a constitution in which the first developer carrying member is fixed to the developing device and the second developer carrying member is swung and in which the first developer carrying member and the second developer carrying member are held by the swingable member with play provided by ball bearings or the like. In a range of play, the second developer carrying member was liable to vibrate and therefore an image was adversely affected.

In the following embodiments, the play is removed by sandwiching and disposing a buffering member of a viscoelastic material between the swingable member and the first developer carrying member and thus the vibration of the second developer carrying member is damped (attenuated), so that a gap fluctuation is suppressed. That is, a tracing performance of the second developer carrying member with respect to the image bearing member rotating at high speed is enhanced to decrease a degree of the fluctuation in opposing gap, so that a developing performance can be stabilized to suppress the improper development and the toner scattering.

<Embodiment 1>

FIG. 6 is an illustration of a constitution of a developing sleeve supporting structure in Embodiment 1 and shows a press-contact state of the developing device as seen from the photosensitive drum side. FIG. 7 is an enlarged view of a swingable holder supporting portion (part A in FIG. 6). FIG. 8 is an illustration of arrangement of an elastic member.

As shown in FIG. 6, the developing sleeve 114 which is the example of the first developer carrying member is set to have the opposing gap with respect to the photosensitive drum 1 by both end abutting portions 114G, and develops the electrostatic image into the toner image on the photosensitive drum 1. The developing sleeve 116 which is the sample of the second developer carrying member is supported by the pair of swingable members 117 and is set to have the opposing gap with respect to the photosensitive drum 1 by both end abutting portions 116G.

The holder 115 which is the example of the supporting member is mounted on the developing container 113 and rotatably supports both end portions of the developing sleeve 114. The swingable holder 117 which is the example of the swingable member is rotatable (movable) about the developing sleeve 114 at a position in which the swingable holder 117 is adjacent to the holder 115.

The lower sleeve urging mechanism 118 which is the example of the urging means urges the developing sleeve 116 toward the photosensitive drum 1. An O ring 121 which is an example of a buffering means is disposed in the opposing gap between the holder 115 and the swingable holder 117 and is capable of damping vibration between the holder 115 and the swingable holder 117 with respect to the rotational direction.

The upper-side developing sleeve 114 is rotatably held by the holder 115 provided on the developing container 113. The lower-side developing sleeve 116 is held at its both end portions by the swingable holder 117 swingably held by the upper-side developing sleeve 114 at both end portions of the developing sleeve 114 with respect to the sleeve axis direction and therefore is swingable about the upper-side developing sleeve 114 as the rotation center.

The fixing rollers 114G provided at both end portions of the developing sleeve 114 abut against the photosensitive drum 1, so that a proper gap is kept between photosensitive drum 1 and the developing sleeve 114. The abutting rollers 116G provided at both end portions of the developing sleeve 116 abut against the photosensitive drum 1, so that a proper gap is kept between the developing sleeve 116 and the photosensitive drum 1. As a result, positioning of the upper-side developing sleeve 114 and the lower-side developing sleeve 116 relative to the photosensitive drum 1 is effected.

In the case where the developing sleeves 114 and 116 are positioned relative to the photosensitive drum 1, the developing sleeves 114 and 116 and the photosensitive drum 1 can be out of alignment due to processing accuracy of respective parts. Each of center axes of the developing sleeves 114 and 116 is not parallel to a center axis of the photosensitive drum 1 in some cases. Or, the enter axis of the developing sleeve 114 is not parallel to the center axis of the developing sleeve 116 in some cases.

The swingable holder 117 for connecting the developing sleeves 114 and 116 is provided at each of both end portions of the developing sleeves 114 and 116. These swingable holders 117 are separately swung, so that the out of alignment can be absorbed. In a status of the out of alignment, the upper-side developing sleeve 114 is positioned as shown in FIG. 5 while keeping the proper gap with respect to the photosensitive drum 1 by the rotational movement of the developing container 113. On the other hand, the developing sleeve 116 is positioned while keeping the proper gap with respected to the photosensitive drum 1 by the swing of each of the swingable holders 117. Relative to the developing sleeve 114, both end portions of the developing sleeve 116 are smoothly swung, so that the proper gap between the developing sleeve 116 and the photosensitive drum 1 can be maintained with a necessary minimum urging force without exerting an excessive urging force.

The O ring 121 which is annular buffering member of a rubber material is disposed between the swingable holder 117 and the holder 115 and is placed in a compressed state by being sandwiched between the swingable holder 117 and the holder 115. The O ring 121 is a ring member formed of the rubber material which is an example of a viscoelastic material and is disposed coaxially with the developing sleeve 114 and thus is compressed in the axial direction between the holder 115 and the swingable holder 117. The O ring 121 is compressed in a range in which the O ring is capable of frictional rotation together with at least one of the holder 115 and the swingable holder 117.

As shown in FIG. 7, the O ring (ring member) 121 has one ring member contact surface, at which the ring member contacts the holder 115 or the swingable holder 117, which is flat and has the other ring member contact surface at which a periodical projection-recess structure is formed with respect to the rotational direction.

On an edge surface of the holder 115 of the developing sleeve 114, radial projections 119 tilted toward the axial center are provided at a plurality of positions. By forming the radial projections 119, the O ring 121 is largely deformed at a small total pressure, so that viscoelasticity with respect to a torsional direction and a vibration damping performance by friction are enhanced.

As shown in FIG. 8, the upper-side developing sleeve 114 can be smoothly rotated by a bearing 122 provided in the holder 115, and the lower-side developing sleeve 116 can be smoothly rotated by a bearing 122 provided in the swingable holder 117.

At a position of the swingable holder 117 opposing the holder 115 provided with the projections 119, an inclined abutting surface 120 which is retracted in a mortar shape toward the axial center is provided. The O ring 121 pressed against the inclined abutting surface 120 by the projections 119 is deformed with respect to a diameter reduction direction, thus fastening outer races (rings) of the two bearings 122 provided inside the holder 115 and the swingable holder 117. As a result, the O ring 121 is compressed in a space defined by the projections 119, the inclined abutting surface 120 and the two bearings 122, so that a repelling force is generated.

The developing device 4 includes the pair of upper-side and lower-side developing sleeves 114 and 116, and the lower-side developing sleeve 116 is swung relative to the upper-side developing sleeve 114. The lower-side developing sleeve 116 supported by the swingable holder (plate) 117 is swung as needed, so that the developing device 4 is capable of effecting optimum development while ensuring the proper gaps between the photosensitive drum 1 and the pair of developing sleeves 114 and 116.

However, the developing device 4 receives the vibration from a driving system therefor or a driving system for driving another unit. This vibration consequently reaches the developing sleeves 114 and 116 subjected to the development and the abutting rollers 116G, thus adversely affecting the development. Specifically, when the abutting rollers 116G vibrate, the gap between the developing sleeve 116 and the photosensitive drum 1 fluctuate, so that the development non-uniformity occurs. Or, the vibration results in speed fluctuation, thus causing the development non-uniformity in some cases.

In the developing device 4, the swingable holder 117 is engaged with the developing sleeves 114 and 116 through the bearings 122 and therefore a latitude of motion of the swingable holder 117 is large by the play or the like of the bearings 122, so that the vibration can occur conspicuously. However, the O ring 121 which exhibits the viscoelasticity and the frictional force to damp the vibration is sandwiched between the holder 115 and the swingable holder 117 to exert the repelling force, so that the play and the vibration are effectively removed and thus the development non-uniformity can be effectively suppressed.

Specific effects of the annular buffering member 121 are achieved as follows.

A first effect is prevention of unnecessary motion of the swingable holder 117 by holding the swingable holder 117 by the repelling force. As described above, the swingable holder 117 is engaged with the developing sleeves 114 and 116 through the bearings 122 and therefore the swingable holder 117 can set up free motion correspondingly to the play (about 10 μm) of the bearings 122 and play of engagement (about 10 μm to about 20 μm) when the swingable holder 117 is left as it is. The annular buffering member 121 is placed between the holder 115 and the swingable holder 117, so that the swingable holder 117 is held by the repelling force and thus the free motion of the swingable holder 117 is prevented, so that the vibration is effectively damped. Further, by a feature that such a buffering means is sandwiched and disposed between the supporting member and the swingable member, vibration suppression is realized in the same outer appearance as that of the conventional developing device.

A second effect is absorption of the vibration by a damping performance of the annular buffering member 121. As one of vibration transmission paths, there is a path from the developing container 113 to the developing sleeves 114 and 116 through the holder 115 and the swingable holder 117. In this case, the elastic (buffering) member 121 is placed between the upper-side holder 115 and the swingable holder 117, so that it becomes possible to effectively damp the vibration transmitted from the holder 115 to the swingable holder 117.

A third effect is prevention of vibration motion of the swingable holder 117 in a vibration direction by the frictional force acting between the annular buffering member 121 and the swingable holder 117. The O ring 121 is contacted to the swingable holder 117 on the circumference with the center axis of the upper-side developing sleeve 114 as the center and therefore it is possible to effectively damp the vibration of the swingable holder 117 in the vibration direction with the center axis of the developing sleeve 114 as the center.

In this case, the frictional force acting between the annular buffering member 121 and the swingable holder 117 is sufficiently smaller than a force for urging the developing sleeve 116 by the lower sleeve urging mechanism 118 (FIG. 3). For this reason, the annular buffering member 121 does not constitute an obstacle to provide the proper gap between the developing sleeve 116 and the photosensitive drum 1 by swinging the developing sleeve 116.

Further, the O ring 121 is defined from three directions by the projections inclined so as to be more spaced from the O ring 121 at a position closer to the center axis, the inclined abutting surface 120 inclined so as to be more spaced from the O ring 121 at a position closer to the center axis, and the bearings 121. The O ring 121 is configured so as to be sandwiched and compressed from the three directions and therefore the O ring 121 is not forced out of its original position even when the O ring 121 is urged by the holder 115 and the swingable holder 117, so that it is possible to stably generate.

Further, due to the processing accuracy of the parts, an urging amount (squeezing amount) of the O ring 121 by the projections 119 of the holder 115 and the inclined abutting surface 120 of the swingable holder 117 can vary. However, an urging portion on the holder 115 side is constituted by the projections 119 and therefore the repelling force is lowered compared with the case of whole surface abutment, so that the fluctuation in repelling forced can be reduced even when the urging amount varies.

Incidentally, in Embodiment 1, the projections 119 are provided on the holder 115 but a similar effect can be obtained also by providing the projections 119 on the swingable holder 117 side.

Further, in FIG. 8, dimensions of the respective members are exaggeratedly illustrated for easily understanding functions. Actual dimensions are such that the developing sleeves 114 and 116 are 20 mm in diameter and are spaced with 500 μm, that the bearings 122 are 16 mm in outer diameter and 10 mm in inner diameter, and that the O ring 121 is 1.2 mm in outer diameter and 1.0 mm in inner diameter.

<Embodiment 2>

The supporting member is not limited to the holder 115. The supporting member may also be a bearing portion of the developing sleeve 114 integrally formed as a part of the developing container 113.

The abutting portion is not limited to the fixing rollers 114G and 116G. The abutting portion may also be a ring of an insulating material provided at both end portions of the developing sleeves.

The buffering member is not limited to the O ring 121. As the buffering member, it is possible to employ a friction plate, a viscous material, a material possessing internal friction, a nonwoven fabric pad, and the like so long as these materials is capable of damping the vibration between the holder 115 and the swingable holder 117.

In the developing device of the present invention, relative vibration between the supporting member and the swingable member with respect to the rotational direction is damped by the buffering means and therefore even when the image bearing member rotates at high speed, both end abutting portions of the second developer carrying member are less liable to rise from the image bearing member.

Therefore, in the developing device including the swingable member swingably holding the second developer carrying member about the first developer carrying member, the inconveniences caused by the vibration of the swingable member can be suppressed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 039954/2010 filed Feb. 25, 2010, which is hereby incorporated by reference.

What is claimed is:

1. A developing device comprising:

a first developer carrying member for forming a toner image on an image bearing member;

a second developer carrying member for forming the toner image on the image bearing member;

a supporting member for rotatably supporting said first developer carrying member;

a swingable member for swinging said second developer carrying member about said first developer carrying member;

urging means for urging said second developer carrying member toward the image bearing member; and an elastic member supported by said supporting member and said swingable member in a compression state between said supporting member and said swingable member, said elastic member being provided movably relative to at least one of said supporting member and said swingable member.

2. A developing device according to claim 1, wherein said elastic member is a ring member, which is disposed coaxially with said first developer carrying member, and which is compressed in an axial direction between said supporting member and said swingable member.

3. A developing device according to claim 2, wherein said ring member is compressed in a range in which said ring member is friction-rotatable with at least one of said supporting member and said swingable member.

4. A developing device according to claim 3, wherein said ring member is contacted to one of said supporting member and said swingable member at one contact surface which is flat, and is contacted to the other one of said supporting member and said swingable member at the other contact surface at which a periodical projection-recess structure is formed with respect to a rotational direction.

* * * * *